US007666043B1

(12) United States Patent
Anderson

(10) Patent No.: US 7,666,043 B1
(45) Date of Patent: Feb. 23, 2010

(54) AUTOMATIC HEAT EXCHANGER FLUSHING MAINTENANCE SYSTEM

(76) Inventor: Perry Anderson, 401 Clinton St., Ashland, OR (US) 97520

( * ) Notice: Subject to any disclaimer, the term of this patent is extended or adjusted under 35 U.S.C. 154(b) by 36 days.

(21) Appl. No.: 12/080,629

(22) Filed: Apr. 3, 2008

Related U.S. Application Data

(60) Provisional application No. 61/062,429, filed on Jan. 25, 2008.

(51) Int. Cl.
*F01P 3/20* (2006.01)

(52) U.S. Cl. ..... 440/88 N; 440/88 HE; 165/297

(58) Field of Classification Search ..... 440/88 C, 440/88 HE, 88 N, 88 R; 123/41.08, 41.09, 123/41.1; 165/297, 298
See application file for complete search history.

(56) References Cited

U.S. PATENT DOCUMENTS 5,004,042 A * 4/1991 McMorries et al. ..... 440/88 HE
5,251,670 A 10/1993 Bates
5,362,265 A 11/1994 Gervais
5,362,266 A 11/1994 Brogdon
5,393,252 A 2/1995 Brogdon
5,441,431 A 8/1995 Brogdon
5,746,270 A * 5/1998 Schroeder et al. ..... 440/88 HE
5,980,342 A 11/1999 Logan et al.
6,579,136 B1 6/2003 Hahn et al.
6,645,024 B1 11/2003 Zumpano
6,786,782 B1 9/2004 Robinson
7,086,370 B2 * 8/2006 Yonezawa et al. ..... 440/88 R
7,329,162 B1 * 2/2008 Caldwell et al. ..... 440/88 HE

* cited by examiner

*Primary Examiner*—Lars A Olson
(74) *Attorney, Agent, or Firm*—Gerald D. Haynes

(57) ABSTRACT

An automatic heat exchanger flushing and maintenance system includes a heat exchanger having coolant circulation passages and raw water circulation passages disposed in thermal contact with the coolant circulation passages, an engine disposed in fluid communication with the coolant circulation passages, a raw water inlet conduit disposed in fluid communication with the raw water circulation passages of the heat exchanger, a flush fluid supply disposed in fluid communication with the raw water circulation passages of the heat exchanger, at least one flush fluid valve disposed between the flush fluid supply and the raw water circulation passages of the heat exchanger and a valve controller disposed in communication with the at least one flush fluid valve and operable to open and close the at least one flush fluid valve.

16 Claims, 5 Drawing Sheets

AUTOMATIC HEAT EXCHANGER FLUSHING MAINTENANCE SYSTEM

CROSS-REFERENCE TO RELATED APPLICATION

This application claims the benefit of and incorporates by reference in its entirety U.S. Provisional patent application No. 61/062,429, filed Jan. 25, 2008 and entitled, "Clean Marine System; automatic heat exchanger flushing and maintenance system".

FIELD

The present disclosure relates to heat exchangers for marine vessels. More particularly, the present disclosure relates to an automatic heat exchanger flushing and maintenance system which is particularly suitable for a marine heat exchanger.

BACKGROUND

Heat exchangers are used in a variety of applications to transfer heat from one fluid to another through a solid surface. Transfer of heat in heat exchangers can occur through heat absorption or heat dissipation. Heat exchangers are typically designed in such a manner that the materials of construction, thermodynamic laws and liquid characteristics work together to achieve optimal heat transfer results.

Marine heat exchangers are used to transfer heat from an engine coolant to a heat-absorbing medium in marine vessels. Marine heat exchanger systems may include a heat source such as a propulsion engine with a closed coolant system containing circulating coolant, a heat exchanger connected to the coolant system and a raw water suction pump connected to the heat exchanger. The raw water suction pump draws raw water from a water body into the heat exchanger, where heat from the coolant is dissipated to the raw water. The cooled coolant is returned to the engine and the heated raw water is discharged back into the water body. An expansion tank may be included in the coolant system to accommodate changes in coolant volume which are produced by different temperatures and pressures.

Periodically during operation of a marine engine, it is necessary to flush and maintain the raw water system to prevent premature corrosion and failure of the system. Therefore, what is needed is an automatic heat exchanger flushing and maintenance system which facilitates automatic flushing and maintenance of a heat exchanger at selected time intervals.

SUMMARY

The present disclosure is generally directed to an automatic heat exchanger flushing and maintenance system. An illustrative embodiment of the automatic heat exchanger flushing and maintenance system includes a heat exchanger having coolant circulation passages and raw water circulation passages disposed in thermal contact with the coolant circulation passages, an engine disposed in fluid communication with the coolant circulation passages, a raw water inlet conduit disposed in fluid communication with the raw water circulation passages of the heat exchanger, a flush fluid supply disposed in fluid communication with the raw water circulation passages of the heat exchanger, at least one flush fluid valve disposed between the flush fluid supply and the raw water circulation passages of the heat exchanger and a valve controller disposed in communication with the at least one flush fluid valve and operable to open and close the at least one flush fluid valve.

BRIEF DESCRIPTION OF THE DRAWINGS

The disclosure will now be made, by way of example, with reference to the accompanying drawings, in which.

DETAILED DESCRIPTION

Figure 1:
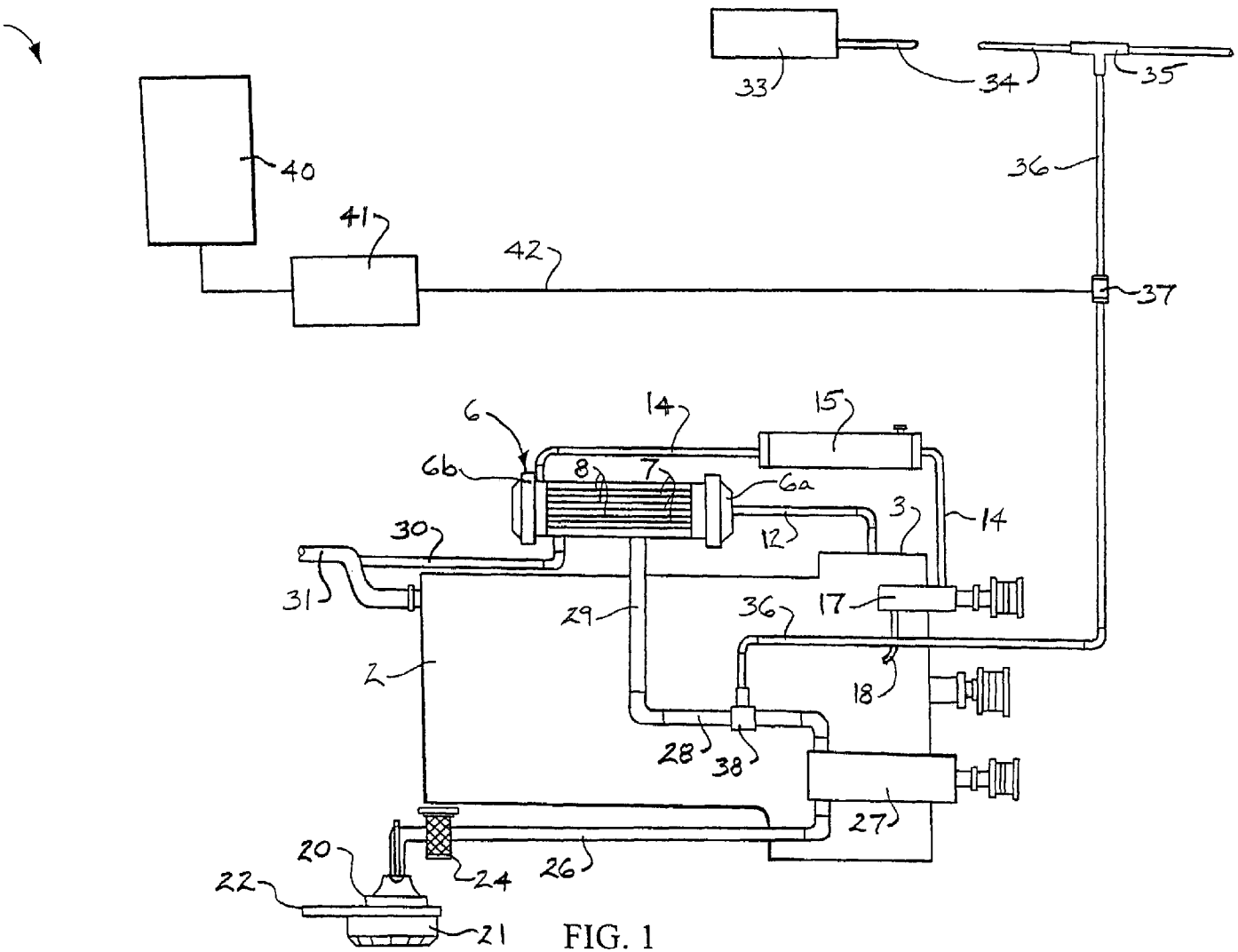
FIG. 1 is a schematic diagram of an illustrative embodiment of the automatic heat exchanger flushing and maintenance system.

Referring initially to FIG. 1 of the drawings, an illustrative embodiment of the automatic heat exchanger flushing and maintenance system, hereinafter system, is generally indicated by reference numeral 1. The system 1 includes a marine engine 2 which may be a propulsion engine adapted to propel a marine vessel (not illustrated), or may be some other raw water cooled onboard device such as an Air conditioning (AC) unit, a Generator (Gensets), etc. The marine engine 2 may or may not include an inter-cooler, an after-cooler, oil cooler, a transmission cooler and/or an AC/heating unit, in non-exclusive particular. A thermostat 3 is disposed in thermal conduct with the marine engine 2. An engine coolant outlet conduit 12 connects a coolant outlet port (not illustrated) of the marine engine 2 with an inlet port 6*a* of a heat exchanger 6. A coolant return conduit 14 connects an outlet port 6*b* of the heat exchanger 6 with a circulation pump 17 which is connected to the marine engine 2 through an engine coolant inlet conduit 18. An expansion tank 15 may be provided in the coolant return conduit 14.

The heat exchanger 6 includes coolant circulation passages 7 and raw water circulation passages 8 which are structurally separate from and disposed in thermal contact with the coolant circulation passages 7. The coolant circulation passages 7 are disposed in fluid communication with the engine coolant outlet conduit 12 and the coolant return conduit 14. A raw water heat exchanger inlet conduit 29 and a raw water heat exchanger outlet conduit 30 are disposed in fluid communication with the raw water circulation passages 8 of the heat exchanger 6. The raw water heat exchanger outlet conduit 30 may be disposed in fluid communication with an exhaust port 31 which extends from the marine engine 2.

A raw water pump 27 is connected to the raw water heat exchanger inlet conduit 29 such as through a raw water pump outlet conduit 28, for example. A scoop strainer 21, which may be provided with a thru-hull fitting 22, is connected to the raw water pump 27 such as through a raw water inlet conduit 26, for example. A raw water inlet valve 20 may be disposed between the scoop strainer 21 and the raw water inlet conduit 26. A raw water strainer 24 may be provided in the raw water inlet conduit 26.

A flush fluid supply 33 is connected to the raw water pump outlet conduit 28 such as through a flush fluid supply conduit 34 and a flush fluid delivery conduit 36, for example. The flush fluid supply 33 may be an on-board or dockside supply of flush fluid such as water or any other liquid which is suitable for flushing and removing impurities from the raw water circulation passages 8 of the heat exchanger 6. The flush fluid delivery conduit 36 may be connected to the on-board flush fluid conduit 34 through a tee fitting 35 and to the raw water pump, outlet conduit 28 through a tee fitting 38, for example. A flush fluid valve 37 is provided in the flush fluid delivery conduit 36. The flush fluid valve 37 may be a manually-operated valve or alternatively, may be a motor drive valve; a pneumatic valve; a hydraulic valve; or a solenoid valve, for example and without limitation. In some embodiments, a valve controller 40 and a digital switching controller 41 are connected to the flush fluid valve 37 through a suitable wired or wireless control pathway 42. The valve controller 40 may be, for example, a single or dual toggle switch; a rocker switch; or other electronic control. The valve controller 40 may include a user interface (not illustrated) such as a keypad, for example, which initiates programmed and automatic purging or flushing of the raw water circulation passages 8 in the heat exchanger 6 in operation of the system 1, which will be hereinafter described. The valve controller 40 may further include time-setting functions to program timed operation of the flush fluid valve 37. Accordingly, the digital switching controller 41 is adapted to open and close the flush fluid valve 37 responsive to manual or programmed input from the valve controller 40.

In typical operation of the system 1, the raw water pump 27 pumps raw water (not illustrated) from a water body (not illustrated) through the scoop strainer 21, the raw water inlet valve 20, the raw water inlet conduit 26, the raw water pump outlet conduit 28 and the raw water heat exchanger inlet conduit 29 and into the heat exchanger 6, respectively. In the heat exchanger 6, the raw water flows through the raw water circulation passages 8. The raw water is distributed from the heat exchanger 6 through the raw water heat exchanger outlet conduit 30 and may be discharged through the exhaust port 31 of the marine engine 2.

Throughout operation of the marine engine 2, liquid coolant (not illustrated) is circulated through the marine engine 2 to cool the marine engine 2, typically in the conventional manner. The heated coolant is distributed from the marine engine 2 and into the heat exchanger 6 through the engine coolant outlet conduit 12. In the heat exchanger 6, the coolant flows through the coolant circulation passages 7. Accordingly, heat is dissipated from the coolant to the raw water as the raw water flows through the raw water circulation passages 8 of the heat exchanger 6. The circulation pump 17 pumps the cooled coolant from the heat exchanger 6 and back into the marine engine 2 through the coolant return conduit 14, the expansion tank 15 and the engine coolant inlet conduit 18, respectively. The expansion tank 15 accommodates changes in coolant volume which are produced by different temperatures and pressures of the coolant.

Periodically throughout operation of the marine engine 2, it may be necessary to flush or purge the raw water circulation passages 8 of the heat exchanger 6 to remove salt, corrosion and/or other impurities from the raw water circulation passages 8. Accordingly, through the digital switching controller 41, once the operator shuts down the marine engine 2, Genset or AC units and initiates the CMS cycle, the valve controller 40 opens the normally-closed flush fluid valve 37. This facilitates flow of flush fluid (not illustrated) from the flush fluid supply 33 through the on-board flush fluid supply conduit 34 and the flush fluid delivery conduit 36 and open flush fluid valve 37, and into the raw water pump outlet conduit 28. The flush fluid flows from the raw water pump outlet conduit 28 and into the heat exchanger 6 through the raw water heat exchanger inlet conduit 29. In the heat exchanger 6, the flush fluid flows through the raw water circulation passages 8, cleaning impurities from the raw water circulation passages 8. The flush fluid with removed impurities flows from the heat exchanger 6 through the raw water heat exchanger outlet conduit 30 and is typically discharged from the exhaust port 31 of the marine engine 2. After a measured volume or timed flow of the flush fluid has been distributed from the flush fluid supply 33 to the heat exchanger 6, the valve controller 40 again closes the flush fluid valve 37 to prevent further flow of the flush fluid through the flush fluid delivery conduit 36.

Figure 2:
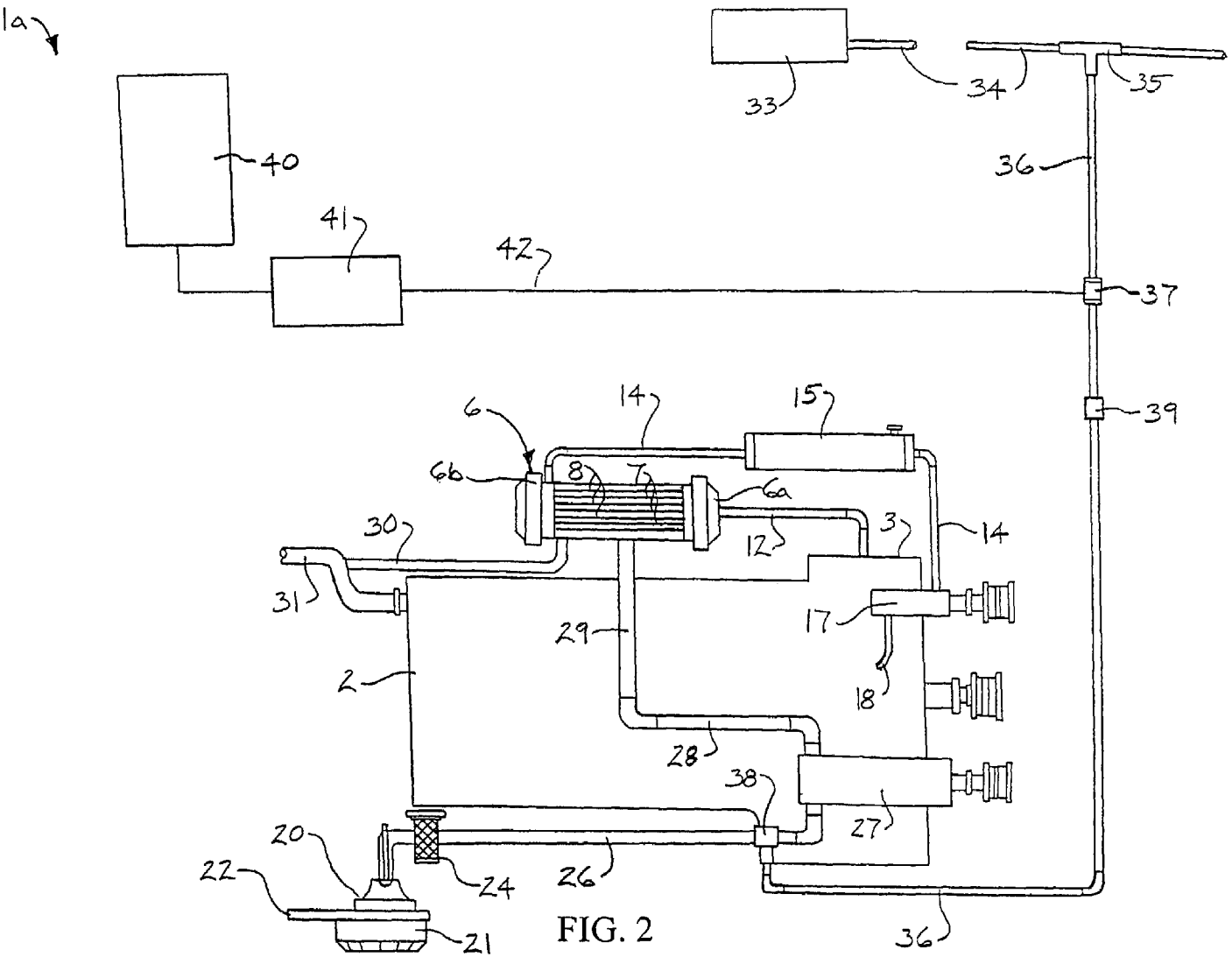
FIG. 2 is a schematic diagram of an alternative illustrative embodiment of the automatic heat exchanger flushing and maintenance system.

Referring next to FIG. 2 of the drawings, an alternative illustrative embodiment of the automatic heat exchanger flushing and maintenance system is generally indicated by reference numeral 1*a*. In the system 1*a*, the flush fluid delivery conduit 36 is connected to the raw water inlet conduit 26 rather than to the raw water pump outlet conduit 28, as was the case with regard to the system 1 which was heretofore described with respect to FIG. 1. A backflow preventer 39 may be provided in the flush fluid delivery conduit 36 to prevent backflow of flush fluid through the flush fluid delivery conduit 36. Accordingly, flushing or purging of the sea strainer and scoop strainer or raw water intake heat exchanger 6 is facilitated by introducing the flush fluid from the flush fluid delivery conduit 36 into the raw water inlet conduit 26. This is accomplished by shutting down the marine engine 2, Genset or AC units and opening of the flush fluid valve 37 by manual or programmed operation of the valve controller 40 typically via the digital switching controller 41. After a measured volume or timed flow of the flush fluid has been distributed from the flush fluid supply 33 to, the valve controller 40 again closes the flush fluid valve 37 to prevent further flow of the flush fluid through the flush fluid delivery conduit 36.

Figure 3:
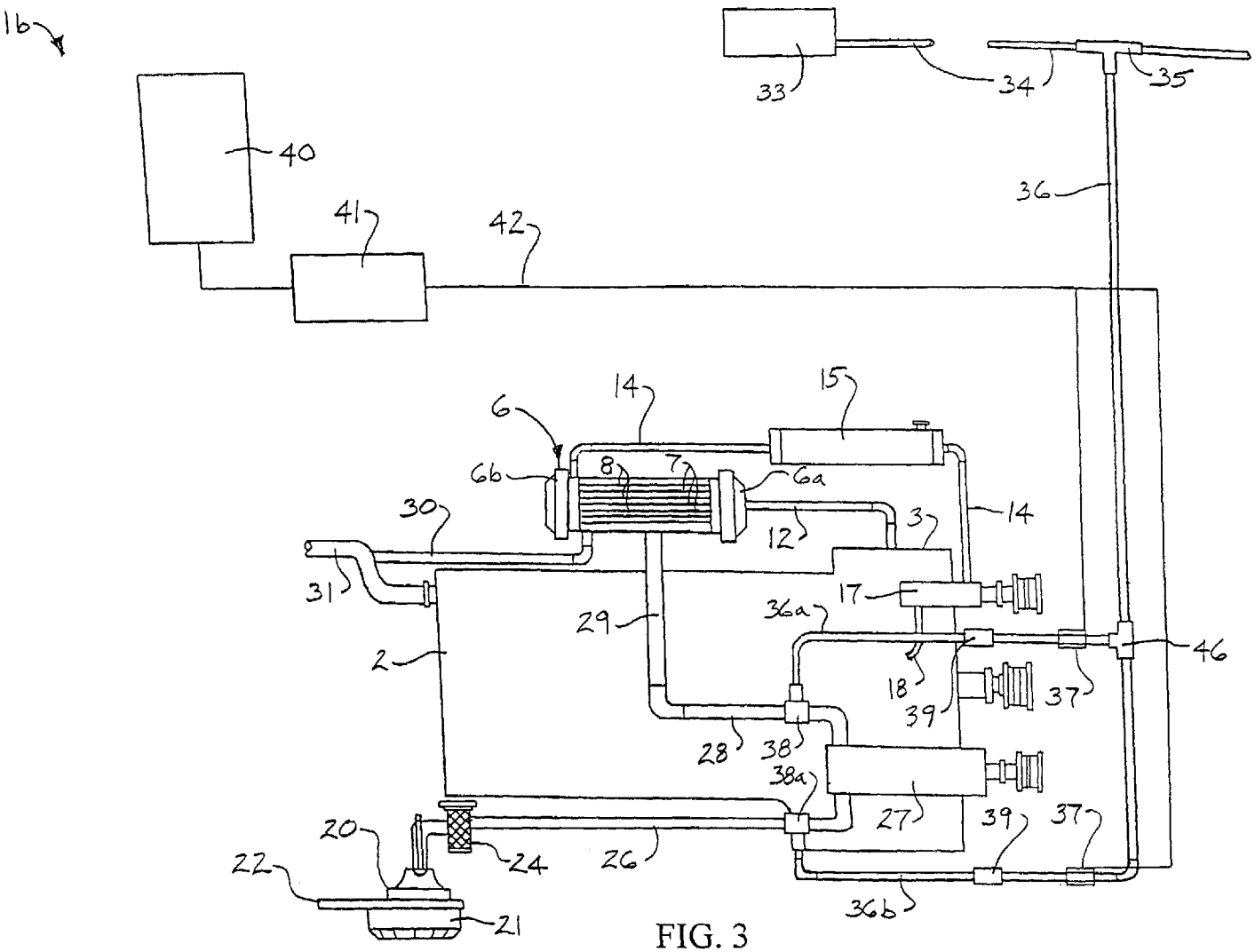
FIG. 3 is a schematic diagram of another alternative illustrative embodiment of the automatic heat exchanger flushing and maintenance system.

Referring next to FIG. 3 of the drawings, another alternative illustrative embodiment of the automatic heat exchanger flushing and maintenance system is generally indicated by reference numeral 1*b*. In the system 1*b*, the flush fluid delivery conduit 36 is connected to the raw water pump outlet conduit 28 through a first conduit branch 36*a* (connected to the flush fluid delivery conduit 36 at a tee fitting 46) and to the raw water inlet conduit 26 through a second conduit branch 36*b*. A flush fluid valve 37 and a backflow preventer 39 may be provided in each of the first conduit branch 36*a* and the second conduit branch 36*b*. The valve controller 40 and the digital switching controller 41 are connected to each fluid flush valve 37 through the control pathway 42. Accordingly, flushing or purging of the heat exchanger 6 is facilitated by introducing the flush fluid from the flush fluid delivery conduit 36 into the raw water pump outlet conduit 28 through the first conduit branch 36*a* and/or from the flush fluid delivery conduit 36 into the raw water inlet conduit 26 through the second conduit branch 36*b*. Either or both of these is accomplished by opening of one or both of the flush fluid valves 37 by manual or programmed operation of the valve controller 40 typically via the digital switching controller 41. Alternatively, in either case or both cases, the raw water pump 27 can be utilized to pump the flush fluid through the raw water circulation passages 8. The inlet 38*a* of the second conduit branch 36*b* with the raw water inlet conduit 26 flushes the raw water and impurities from the raw water inlet conduit 26 and through the sea strainer 24 and discharges out the scoop or raw water intake, effectively back flushing debris out the raw water inlet conduit 26. When the marine engine 2 is off, the raw water pump 27 acts as a valve, effectively closing off the water flow from going up into the heat exchanger 6. At a determined time the flush fluid valve or valves 37 open(s) and allow(s) flushing fluid to enter the heat exchanger 6, cleaning impurities from the raw water circulation passages 8. The flush fluid flows from the heat exchanger 6 through the raw water heat exchanger outlet conduit 30 and is typically discharged from the exhaust port 31 of the marine engine 2. After a measured volume or timed flow of the flush fluid has been distributed from the flush fluid supply 33 to the heat exchanger 6, the valve controller 40 again closes either or both of the flush fluid valves 37 to prevent further flow of the flush fluid to the heat exchanger 6.

Figure 4:
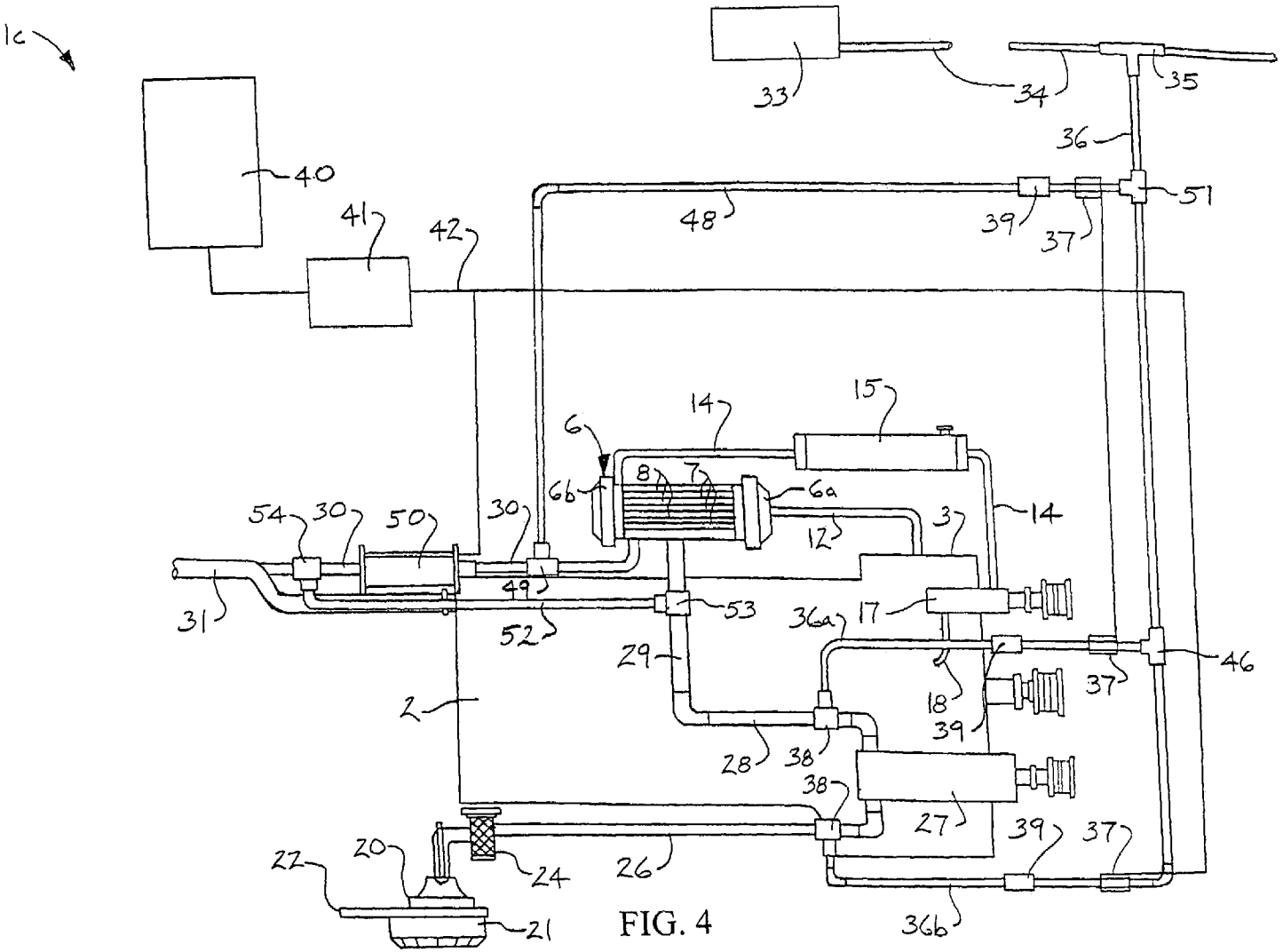
FIG. 4 is a schematic diagram of still another alternative illustrative embodiment of the automatic heat exchanger flushing and maintenance system.

Referring next to FIG. 4 of the drawings, still another alternative illustrative embodiment of the automatic heat exchanger flushing and maintenance system is generally indicated by reference numeral 1*c*. In the system 1*c*, the flush fluid delivery conduit 36 is connected to the raw water pump outlet conduit 28 through a first conduit branch 36*a* and to the raw water inlet conduit 26 through a second conduit branch 36*b*, as was heretofore described with respect to the system 1*b* illustrated in FIG. 3. A flush fluid valve 37 and a backflow preventer 39 may be provided in each of the first conduit branch 36*a* and the second conduit branch 36*b*. The valve controller 40 and the digital switching controller 41 are connected to each fluid flush valve 37 through the control pathway 42.

A flush fluid diversion conduit 48 connects the flush fluid delivery conduit 36 to the raw water heat exchanger outlet conduit 30. A tee fitting 49 and a tee fitting 51 may connect the flush fluid diversion conduit 48 to the raw water heat exchanger outlet conduit 30 and to the flush fluid delivery conduit 36, respectively. A flush fluid valve 37 and a backflow preventer 39 are provided in the flush fluid diversion conduit 48.

An electronic heat exchanger backflush valve 50 may be provided in the raw water heat exchanger outlet conduit 30. The valve controller 40 and the digital switching controller 41 are connected to the heat exchanger backflush valve 50 through the control pathway 42. A heat exchanger backflush conduit 52 is connected to the raw water heat exchanger inlet conduit 29 at a tee fitting 53 and to the raw water heat exchanger outlet conduit 30 at a tee fitting 54. Accordingly, forward flushing or purging of the heat exchanger 6 is facilitated by introducing the flush fluid from the flush fluid delivery conduit 36 into the raw water pump outlet conduit 28 through the first conduit branch 36*a* and/or from the flush fluid delivery conduit 36 into the raw water inlet conduit 26 through the second conduit branch 36*b*. Either or both of these is accomplished by opening of one or both of the corresponding flush fluid valves 37 by manual or programmed operation of the valve controller 40 typically via the digital switching controller 41. Alternatively, in either case or both cases, the raw water pump 27 can be utilized to pump the flush fluid through the raw water circulation passages 8 of the heat exchanger 6, cleaning impurities from the raw water circulation passages 8. The flush fluid flows from the heat exchanger 6 through the raw water heat exchanger outlet conduit 30 and is typically discharged from the exhaust port 31 of the marine engine 2.

Backflushing of the heat exchanger 6 can be accomplished by diverting flush fluid from the flush fluid delivery conduit 36, through the flush fluid diversion conduit 48 and into the raw water heat exchanger outlet conduit 30, from which the flush fluid flows in the reverse direction through the raw water circulation passages 8 of the heat exchanger 6. The flush fluid cleans impurities from the raw water circulation passages 8 and then flows into the raw water heat exchanger inlet conduit 29, through the heat exchanger backflush conduit 52 and into the raw water heat exchanger outlet conduit 30. The flush water may be discharged from the exhaust port 31 of the marine engine 2. The flush water may be distributed from the raw water heat exchanger outlet conduit 30 and back through the heat exchanger 6 by opening of the heat exchanger backflush valve 50 by manual or programmed operation of the valve controller 40 typically via the digital switching controller 41.

Figure 5:
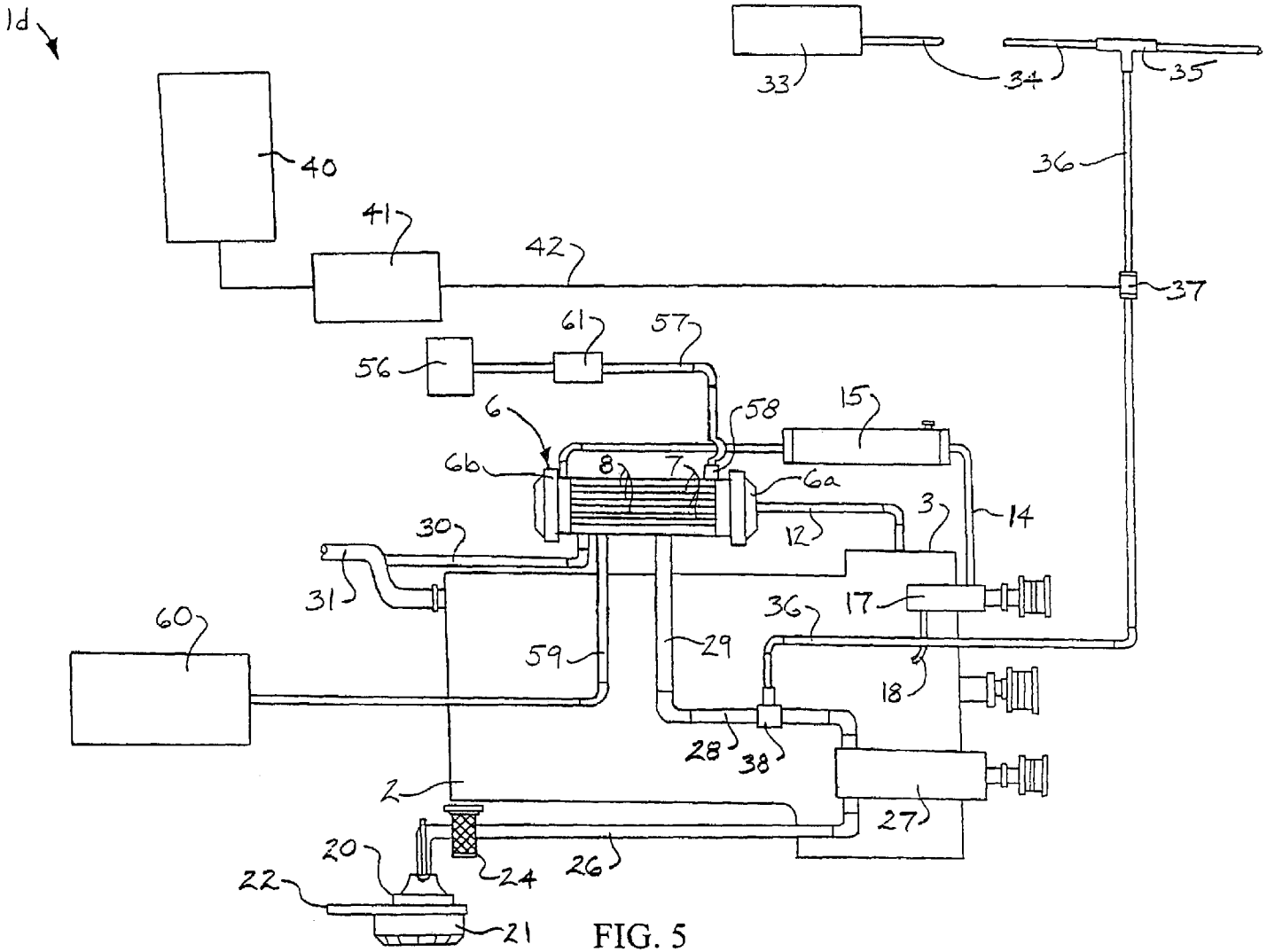
FIG. 5 is a schematic diagram of yet another alternative illustrative embodiment of the automatic heat exchanger flushing and maintenance system.

Referring next to FIG. 5 of the drawings, yet another alternative illustrative embodiment of the automatic heat exchanger flushing and maintenance system is generally indicated by reference numeral 1*d*. In the system 1*d*, a cleaner/protectant tank 56 is disposed in fluid communication with the raw water circulation passages 8 of the heat exchanger 6 such as through a heat exchanger inlet conduit 57, for example. A pump 61 may be provided in the heat exchanger inlet conduit 57. The cleaner/protectant tank 56 is adapted to hold a supply of a liquid cleaner/protectant (not illustrated). In some applications, the liquid cleaner/protectant which is contained in the cleaner/protectant tank 56 may be SIMPLE GREEN® which is available from the Sunshine Makers, Inc. of Huntington Harbor, Calif. The heat exchanger inlet conduit 57 may be detachably coupled to the heat exchanger 6 through a suitable port 58. A holding tank 60, which may be the main holding tank of a marine vessel, for example, is disposed in fluid communication with the raw water circulation passages 8 of the heat exchanger 6 such as through a heat exchanger outlet conduit 59, for example.

In typical application of the system 1*d*, a liquid cleaner/protectant (not illustrated) is placed in the cleaner/protectant tank 56. The raw water circulation passages 8 of the heat exchanger 6 may initially be flushed with raw water, via distribution of raw water into the heat exchanger 6 through the raw water heat exchanger inlet conduit 29 and from the heat exchanger 6 through the raw water heat exchanger outlet conduit 30, as was heretofore described with respect to the systems illustrated in FIGS. 1-4. The pump 61 is operated to pump the liquid cleaner/protectant from the cleaner/protectant tank 56, through the heat exchanger inlet conduit 57 and into the heat exchanger 6. In the heat exchanger 6, the liquid cleaner/protectant flows through the raw water circulation passages 8 and removes any salt, corrosion and/or other, impurities which remain in the raw water circulation passages 8 after flushing using the raw water. The liquid cleaner/protectant is discharged from the heat exchanger 6 and into the holding tank 60 through the heat exchanger outlet conduit 59. The effluent cleaner/protectant may be periodically removed from the holding tank 60.

While the illustrative embodiments of the disclosure have been described above, it will be recognized and understood that various modifications can be made to the embodiments and the appended claims are intended to cover all such modifications which may fall within the spirit and scope of the disclosure.

I claim:

1. An automatic heat exchanger flushing and maintenance system, comprising:

a heat exchanger having coolant circulation passages and raw water circulation passages disposed in thermal contact with the coolant circulation passages;

an engine disposed in fluid communication with the coolant circulation passages;

a raw water inlet conduit disposed in fluid communication with the raw water circulation passages of the heat exchanger;

a flush fluid supply disposed in fluid communication with the raw water circulation passages of the heat exchanger;

at least one flush fluid valve disposed between the flush fluid supply and the raw water circulation passages of the heat exchanger;

a valve controller disposed in communication with the at least one flush fluid valve and operable to open and close the at least one flush fluid valve; and a digital switching controller connected to the valve controller and the at least one flush fluid valve.

2. The system of claim 1 further comprising a scoop strainer disposed in fluid communication with the raw water inlet conduit.

3. The system of claim 1 further comprising a flush fluid delivery conduit communicating with the flush fluid supply and the raw water circulation passages of the heat exchanger and wherein the at least one flush fluid valve is provided in the flush fluid delivery conduit.

4. The system of claim 3 wherein the flush fluid delivery conduit communicates with the raw water inlet conduit.

5. The system of claim 3 further comprising a raw water pump communicating with the raw water inlet conduit and a raw water pump outlet conduit communicating with the raw water pump and the raw water circulation passages of the heat exchanger, and wherein the flush fluid delivery conduit communicates with the raw water pump outlet conduit.

6. The system of claim 1 further comprising a raw water heat exchanger outlet conduit communicating with the raw water passages of the heat exchanger.

7. The system of claim 6 further comprising a cleaner/protectant tank, an exhaust port extending from the engine and a holding tank disposed in fluid communication with wherein the raw water circulation passages of the heat exchanger outlet conduit communicates with the exhaust port.

8. An automatic heat exchanger flushing and maintenance system, comprising:

a heat exchanger having coolant circulation passages and raw water circulation passages disposed in thermal contact with the coolant circulation passages;

an engine disposed in fluid communication with the coolant circulation passages of the heat exchanger;

a raw water pump outlet conduit disposed in fluid communication with the raw water circulation passages of the heat exchanger;

a raw water pump disposed in fluid communication with the raw water pump outlet conduit;

a raw water inlet conduit disposed in fluid communication with the raw water pump;

a flush fluid supply disposed in fluid communication with the raw water pump outlet conduit and the raw water inlet conduit;

a first flush fluid valve disposed between the flush fluid supply and the raw water pump outlet conduit;

a second flush fluid valve disposed between the flush fluid supply and the raw water inlet conduit;

a valve controller disposed in communication with the first flush fluid valve and the second flush fluid valve and operable to open and close the first flush fluid valve and the second flush fluid valve; and a digital switching controller connected to the valve controller and the first flush fluid valve and the second flush fluid valve.

9. The system of claim 8 further comprising a scoop strainer disposed in fluid communication with the raw water inlet conduit.

10. The system of claim 8 further comprising a flush fluid delivery conduit communicating with the flush fluid supply, a first conduit branch extending from the flush fluid delivery conduit and communicating with the raw water pump outlet conduit, a second conduit branch extending from the flush fluid delivery conduit and communicating with the raw water inlet conduit and wherein the first flush fluid valve is provided in the first conduit branch and the second flush fluid valve is provided in the second conduit branch.

11. The system of claim 10 further comprising a backflow preventer provided in each of the first conduit branch and the second conduit branch.

12. The system of claim 8 further comprising a raw water heat exchanger outlet conduit communicating with the raw water passages of the heat exchanger.

13. The system of claim 12 further comprising an exhaust port extending from the engine and wherein the raw water heat exchanger outlet conduit communicates with the exhaust port.

14. An automatic heat exchanger flushing and maintenance system, comprising:

a heat exchanger having coolant circulation passages and raw water circulation passages disposed in thermal contact with the coolant circulation passages;

an engine disposed in fluid communication with the coolant circulation passages;

a raw water inlet conduit disposed in fluid communication with the raw water circulation passages of the heat exchanger;

a raw water heat exchanger outlet conduit disposed in fluid communication with the raw water circulation passages of the heat exchanger;

a flush fluid supply disposed in fluid communication with the raw water circulation passages of the heat exchanger and the raw water heat exchanger outlet conduit;

at least one flush fluid valve disposed between the flush fluid supply and the raw water circulation passages of the heat exchanger; and a valve controller disposed in communication with the at least one flush fluid valve and operable to open and close the at least one flush fluid valve;

a raw water pump disposed in fluid communication with the raw water inlet conduit, a raw water pump outlet conduit disposed in fluid communication with the raw water pump and a raw water heat exchanger inlet conduit disposed in fluid communication with the raw water pump outlet conduit and the raw water circulation passages of the heat exchanger and wherein the flush fluid supply is disposed in fluid communication with the raw water inlet conduit and the raw water pump outlet conduit; and a heat exchanger backflush conduit establishing fluid communication between the raw water heat exchanger inlet conduit and the raw water heat exchanger outlet conduit.

15. The system of claim 14 further comprising a flush fluid valve disposed between the flush fluid supply and the raw water heat exchanger outlet conduit and wherein the valve controller is disposed in communication with the second flush fluid valve disposed between the flush fluid supply and the raw water heat exchanger outlet conduit.

16. The system of claim 14 wherein the at least one flush fluid valve comprises a first flush fluid valve disposed between the flush fluid supply and the raw water pump outlet conduit and a second flush fluid valve disposed between the flush fluid supply and the raw water inlet conduit.

* * * * *